US009486901B2

(12) United States Patent
Tsai

(10) Patent No.: US 9,486,901 B2
(45) Date of Patent: Nov. 8, 2016

(54) SOCKET WRENCH

(71) Applicant: Jen-Chu Tsai, Taichung (TW)

(72) Inventor: Jen-Chu Tsai, Taichung (TW)

( * ) Notice: Subject to any disclaimer, the term of this patent is extended or adjusted under 35 U.S.C. 154(b) by 0 days.

(21) Appl. No.: 14/956,497

(22) Filed: Dec. 2, 2015

(65) Prior Publication Data

US 2016/0158924 A1 Jun. 9, 2016

(30) Foreign Application Priority Data

Dec. 4, 2014 (TW) ..... 103142151 A

(51) Int. Cl.
*B25B 23/16* (2006.01)
*B25B 23/00* (2006.01)
*B25G 1/06* (2006.01)

(52) U.S. Cl.
CPC ..... *B25B 23/0028* (2013.01); *B25B 23/16* (2013.01); *B25G 1/063* (2013.01)

(58) Field of Classification Search
CPC .... B25B 23/0028; B25B 23/16; B25G 1/063
USPC ..... 81/177.8, 177.9, 177.85, 177.75
See application file for complete search history.

(56) References Cited

U.S. PATENT DOCUMENTS 7,040,200 B2 * 5/2006 Lin ..... B25B 13/005 81/177.5
7,311,018 B1 * 12/2007 Liou ..... B25B 13/005 81/177.5
8,387,490 B2 * 3/2013 Lee ..... B25G 1/043 81/177.7
2006/0042425 A1 * 3/2006 Lin ..... B25G 1/063 81/177.9
2006/0201288 A1 * 9/2006 Chen ..... B25B 13/461 81/177.8
2011/0056335 A1 * 3/2011 Lin ..... B25B 13/466 81/58.1
2011/0072941 A1 * 3/2011 Tsai ..... B25G 1/063 81/177.8
2012/0144960 A1 * 6/2012 Huang ..... B25G 1/063 81/177.8

FOREIGN PATENT DOCUMENTS

TW 1321081 B 3/2010

* cited by examiner

*Primary Examiner* — Hadi Shakeri
*Assistant Examiner* — Danny Hong
(74) *Attorney, Agent, or Firm* — Guice Patents PLLC

(57) ABSTRACT

A socket wrench includes a head unit with two lug members, a tubular shaft, a handle rod, a first spring-loaded member disposed to permit the tubular shaft to be rotatably engaged with the head unit, and a second spring-loaded member disposed to permit the handle rod to be slidably engaged with the tubular shaft. The handle rod has front and rear end segments each having a cavity configured such that when the handle rod is displaced to a forward or rearward position, the second spring-loaded member is engaged therein, and such that when the handle rod is moved away from the forward or rearward position, the second spring-loaded member can slide out of the cavity.

8 Claims, 11 Drawing Sheets

SOCKET WRENCH

CROSS-REFERENCE TO RELATED APPLICATION

This application claims priority from Taiwanese application no. 103142151, filed on Dec. 4, 2014.

FIELD

The disclosure relates to a socket wrench, more particularly to a socket wrench with a linearly displaceable handle rod.

BACKGROUND

Taiwanese patent no. 1321081 discloses a socket wrench 1, as shown in FIGS. 1 and 2. The socket wrench 1 includes a head 11, a tubular shaft 12, a handle 13, first and second biasing units 14, 16, and two C-shaped hoops 15. The head 11 includes two lugs 112 and a driving stud 111. A socket (not shown) may be coupled to the driving stud 111 for turning, for example, a nut. The tubular shaft 12 extends through slots of the lugs 112, and the handle 13 is inserted through a through bore 121 of the tubular shaft 12 so as to be movably retained in the tubular shaft 12. The two C-shaped hoops 15 respectively engage two opposite ends of the handle 13 so as to prevent undesired removal of the handle 13 from the tubular shaft 12 through the through bore 121. The first biasing unit 14 includes a spring 141 and a steel ball 142. The spring 141 is disposed in an outer surface of the tubular shaft 12, and biases the steel ball 142 to extend outwardly of the outer surface of the tubular shaft 12. When two opposite ends of the tubular shaft 12 are respectively journaled in the slots of the two lugs 112, the steel ball 142 is urged by the spring 141 to engage one of the lugs 112. The second biasing unit 16 includes a spring 161 and a steel ball 162. The spring 161 is disposed in an inner surface of the tubular shaft 12 which defines the through bore 121, and biases the steel ball 162 to extend into the through bore 121. When the handle 13 extends through the through bore 121, the steel ball 162 is urged by the spring 161 to engage the handle 13 so as to permit the handle 13 to be slidably engaged with the tubular shaft 12.

In the conventional socket wrench 1, although the handle 13 is linearly slidable to permit the socket wrench 1 to be used in a limited space, the handle 13 is also rotatable about its lengthwise axis. Thus, when the conventional socket wrench 1 is used to turn a nut (not shown), a force applied to the handle 13 might cause rotation of both the nut and the handle 13, hence requiring exertion of a greater force for tightening the nut.

In addition, as shown in FIG. 2, due to the provision of the C-shaped hoops 15, the handle 13 and each of the lugs 112 are spaced apart from each other by a gap (g). Because of the presence of the gap (g), a force exerted on the handle 13 to turn the handle 13 cannot be evenly distributed to the lugs 112 so that the handle 13 may crack due to stress concentration.

SUMMARY

Therefore, an object of the disclosure is to provide a novel socket wrench in which a handle rod is not rotatable about its lengthwise axis, and in which the handle rod can abut against inner surfaces of lug members when a force is applied thereto for fastening an object.

According to the disclosure, a socket wrench includes a head unit, a tubular shaft, a handle rod, and first and second spring-loaded members. The head unit includes a base, a driving member extending downwardly from the base, and left and right lug members. The left and right lug members extend upwardly from the base and are spaced apart from each other by a gap in a transverse direction. Each of the left and right lug members has a slot extending along a central axis in the transverse direction. The tubular shaft extends along the central axis to terminate at left and right journal ends which are respectively journaled in the slots of the left and right lug members so as to permit the tubular shaft to be rotatable about the central axis. The tubular shaft has a through bore which extends in a radial direction relative to the central axis, and which has a polygonal contour. The handle rod defines a lengthwise axis, and has front and rear end segments opposite to each other, and a middle segment disposed between the front and rear end segments. The handle rod is configured to extend through the through bore such that the handle rod is displaceable among a forward position, where the front end segment is in the through bore, a rearward position, where the rear end segment is in the through bore, and a middle position, where the middle segment is in the through bore. The handle rod has a polygonal cross-section to mate with the polygonal contour of the through bore so as to prevent rotation of the handle rod about the lengthwise axis. The first spring-loaded member has a first biasing force. The first spring-loaded member is disposed in the tubular shaft and extends outwardly of an outer surface of the tubular shaft such that when the left and right journal ends of the tubular shaft are respectively journaled in the slots of the left and right lug members, the first spring-loaded member is urged by the first biasing force to engage one of the left and right lug members so as to permit the tubular shaft to be rotatably engaged with the head unit. The second spring-loaded member has a second biasing force. The second spring-loaded member is disposed in an inner peripheral surface of the tubular shaft which defines the through bore, and extends into the through bore such that when the handle rod extends through the through bore, the second spring-loaded member is urged by the second biasing force to engage the handle rod so as to permit the handle rod to be slidably engaged with the tubular shaft. The second spring-loaded member is displaceable between a partially engaged position, where the handle rod is in the middle position, and a fully engaged position, where the handle rod is in one of the forward and rearward positions. Each of the front and rear end segments of the handle rod has a cavity configured to permit the second spring-loaded member to be engaged therein when the second spring-loaded member is in the fully engaged position. The cavity extends inwardly to form an inner ramp-up surface and an inner barrier surface. The inner ramp-up surface and the inner barrier surface are opposite to each other in a direction of the lengthwise axis, and are disposed proximate to and distal from the middle segment, respectively. The inner ramp-up surface is configured to permit the second spring-loaded member to slide out of the cavity against the second biasing force to thereby permit the handle rod to move away from corresponding one of the forward and rearward positions.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
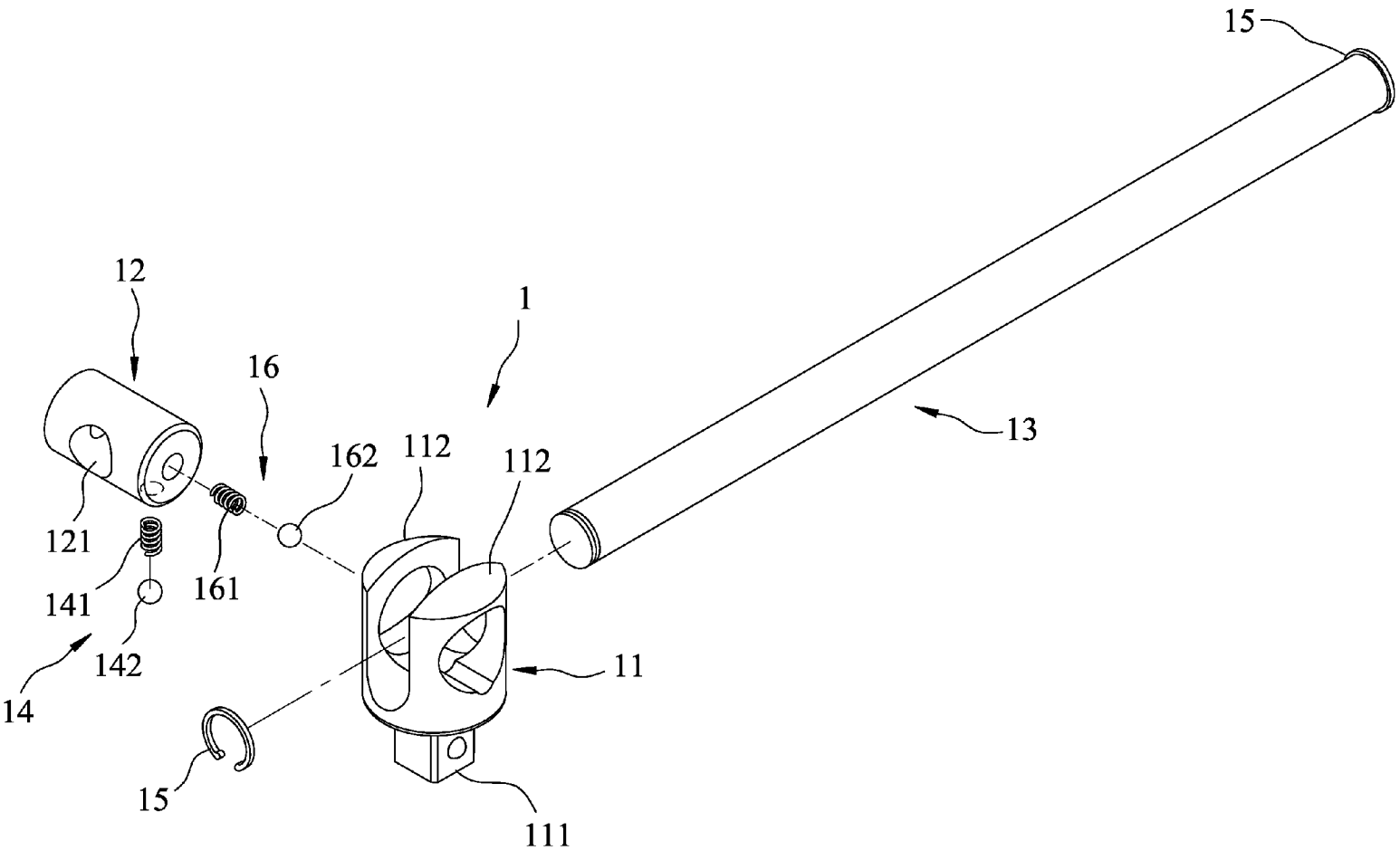
FIG.1 PRIOR ART
FIG. 1 is an exploded perspective view of a conventional socket wrench.
Figure 2:
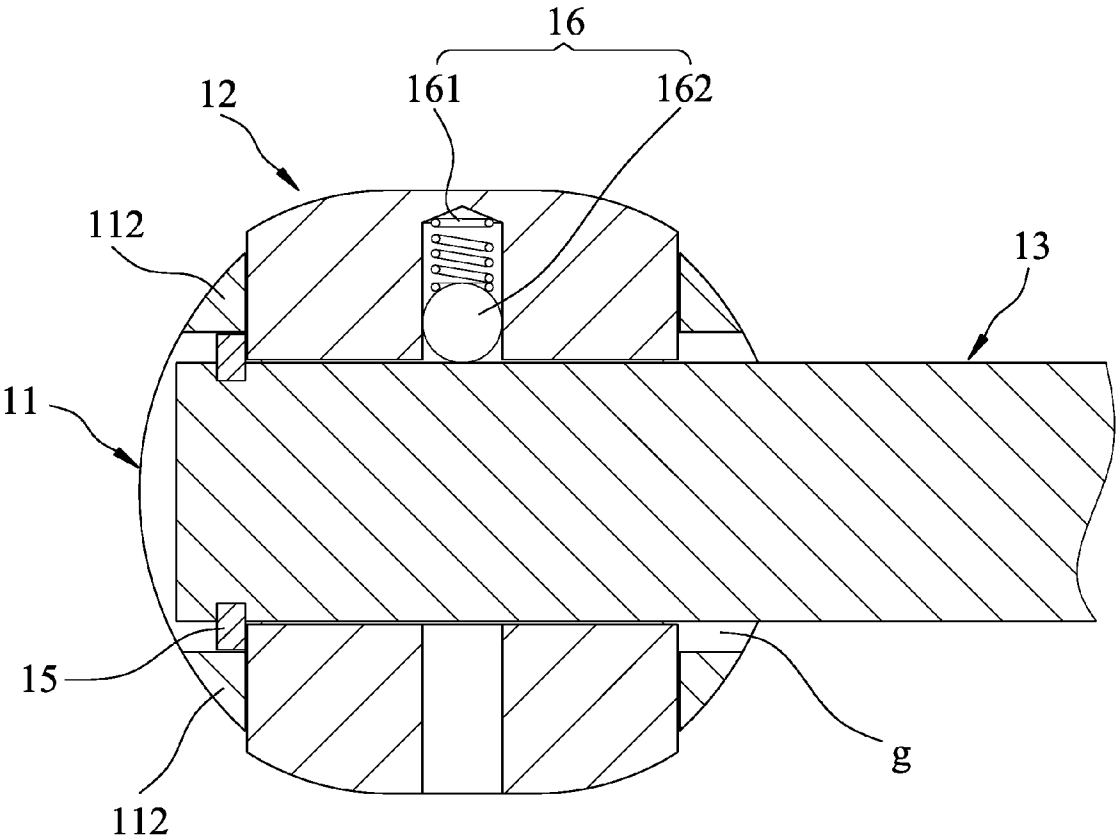
FIG.2 PRIOR ART
FIG. 2 is a fragmentary cross-sectional view of the conventional socket wrench.

Before the disclosure is described in greater detail, it should be noted that like elements are denoted by the same reference numerals throughout the disclosure.

Figure 3:
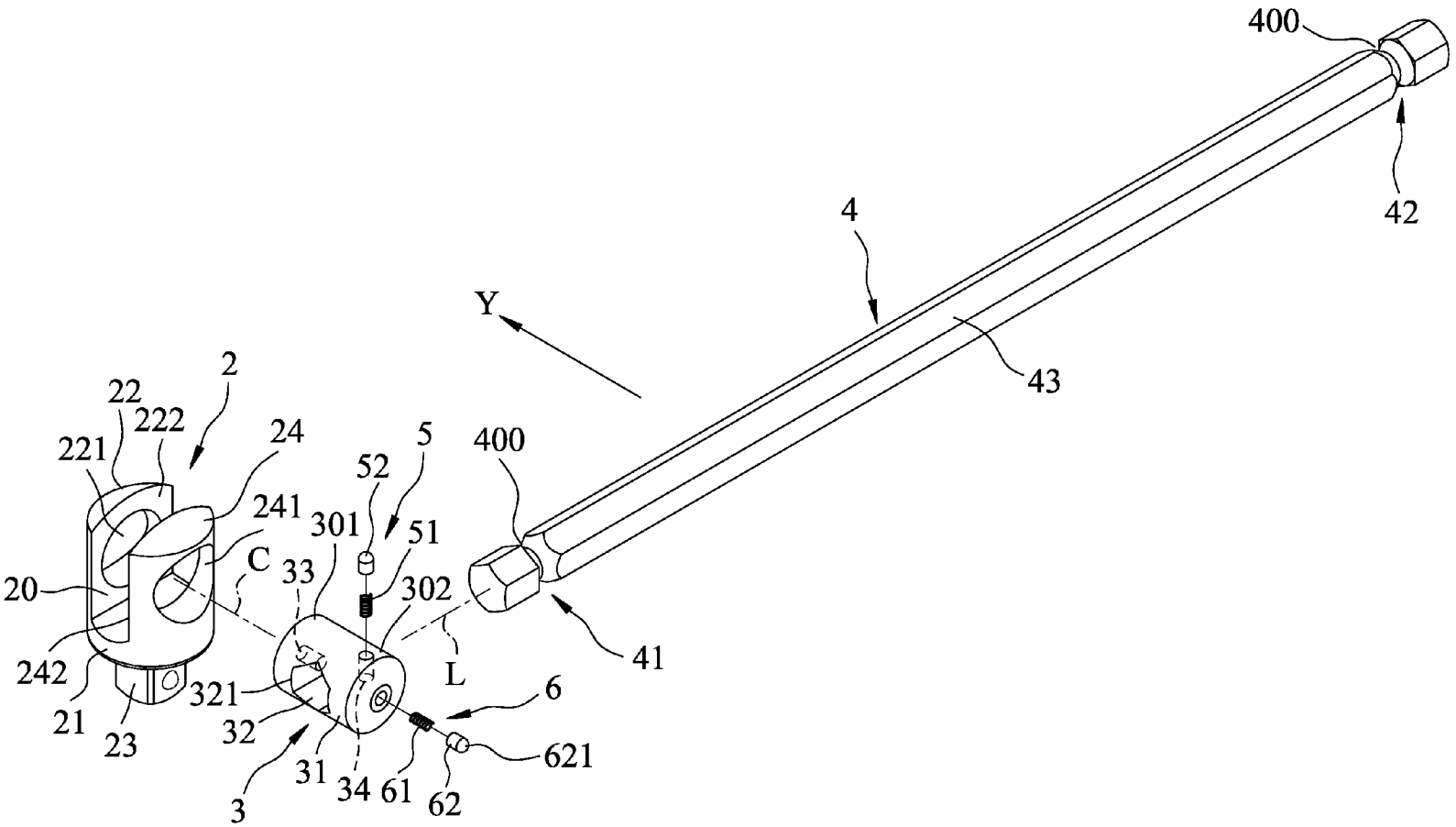
FIG. 3 is an exploded perspective view of a socket wrench according to a first embodiment of the disclosure.
Figure 4:
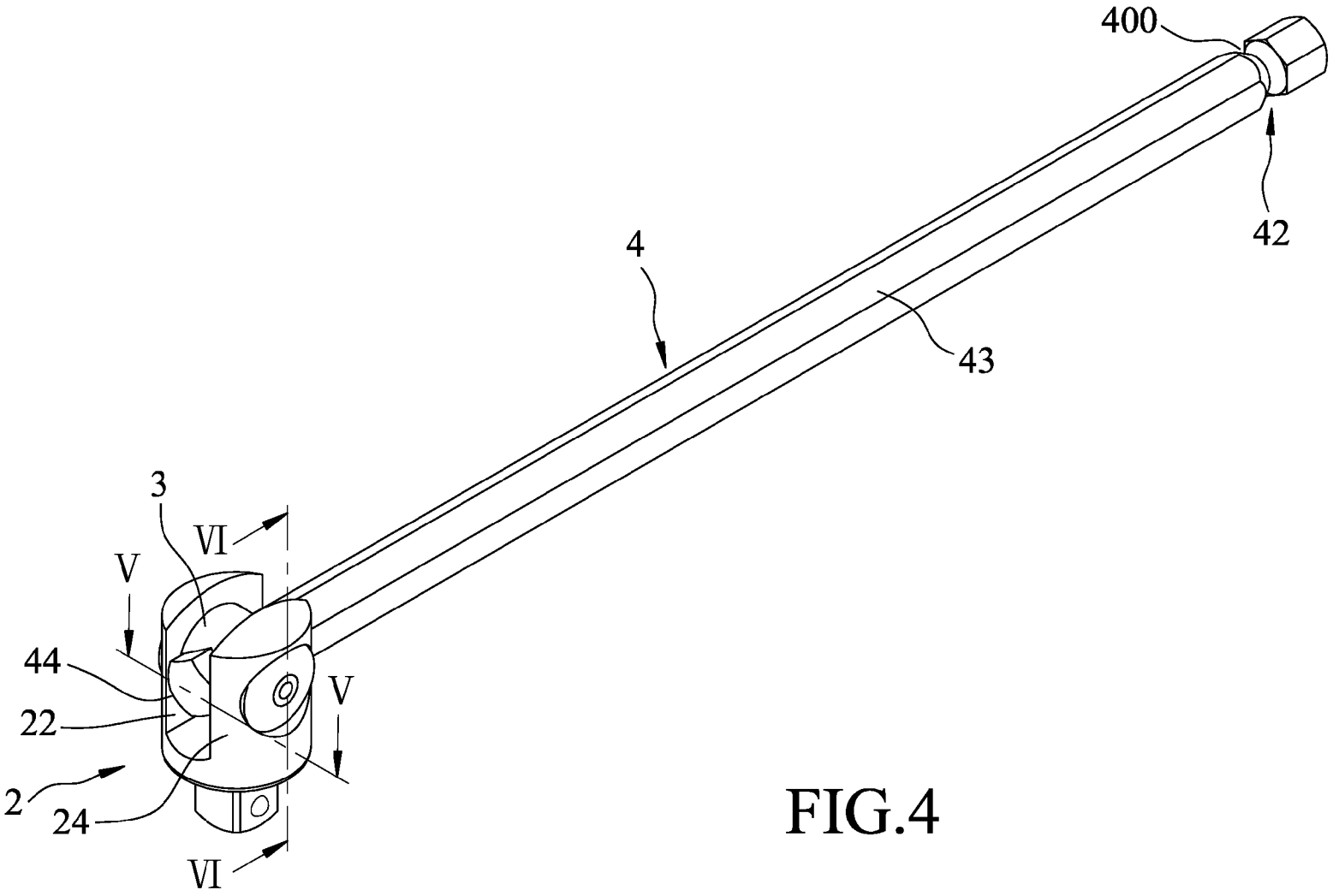
FIG. 4 is a perspective view of the socket wrench of the first embodiment in an assembled state.

With reference to FIGS. 3 and 4, a socket wrench according to a first embodiment of the disclosure includes a head unit 2, a tubular shaft 3, a handle rod 4, and first and second spring-loaded members 5, 6.

The head unit 2 includes a base 21, a driving member 23 extending downwardly from the base 21, and left and right lug members 22, 24. The left and right lug members 22, 24 extend upwardly from the base 21 and are spaced apart from each other by a gap 20 in a transverse direction (Y). The left and right lug members 22, 24 respectively have inner surfaces 222, 242 which are spaced apart from each other by the gap 20. Each of the left and right lug members 22, 24 has a slot 221, 241 extending along a central axis (C) in the transverse direction (Y).

The tubular shaft 3 extends along the central axis (C) to terminate at left and right journal ends 301, 302 which are respectively journaled in the slots 221, 241 of the left and right lug members 22, 24 so as to permit the tubular shaft 3 to be rotatable about the central axis (C). The tubular shaft 3 has a through bore 321 which extends in a radial direction relative to the central axis (C), and which has a polygonal contour.

The handle rod 4 defines a lengthwise axis (L), and has front and rear end segments 41, 42 opposite to each other, and a middle segment 43 disposed between the front and rear end segments 41, 42. The handle rod 4 is configured to extend through the through bore 321 such that the handle rod 4 is displaceable among a forward position (see FIG. 4), where the front end segment 41 is in the through bore 321, a rearward position (not shown), where the rear end segment 42 is in the through bore 321, and a middle position (see FIG. 7), where the middle segment 43 is in the through bore 321. The handle rod 4 has a polygonal cross-section to mate with the polygonal contour of the through bore 321 so as to prevent rotation of the handle rod 4 about the lengthwise axis (L). The polygonal cross-section of the handle rod 4 can be of any shape, such as triangle, quadrangle, hexagon, etc. In this embodiment, the polygonal cross-section of the handle rod 4 is of a hexagonal shape.

Figure 6:
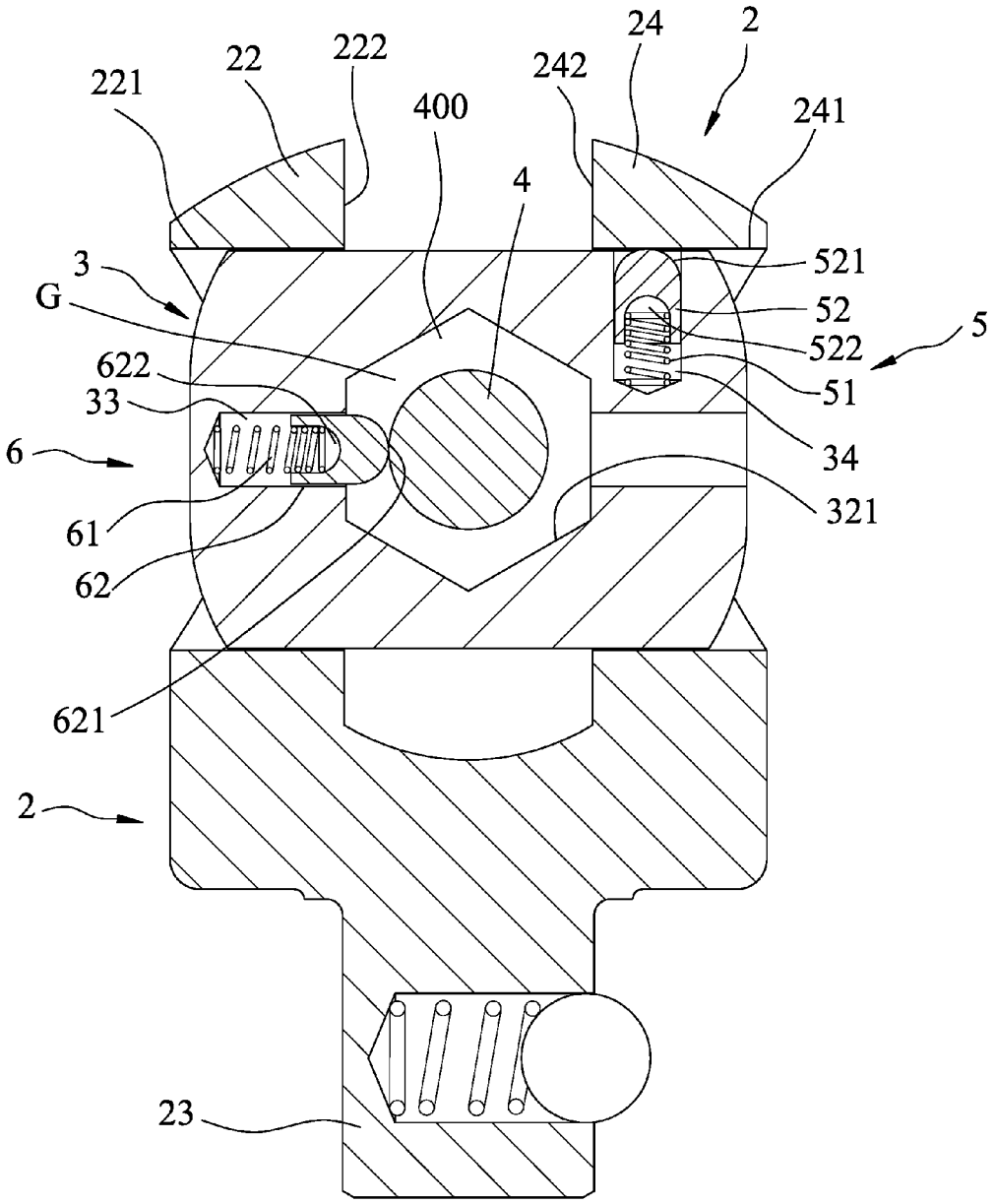
FIG. 6 is a cross-sectional view taken along line VI-VI of FIG. 4.

The first spring-loaded member 5 has a first biasing force. The first spring-loaded member 5 is disposed in a recess 34 of the tubular shaft 3 and extends outwardly of an outer surface 31 of the tubular shaft 3 such that when the left and right journal ends 301, 302 of the tubular shaft 3 are respectively journaled in the slots 221, 241 of the left and right lug members 22, 24, the first spring-loaded member 5 is urged by the first biasing force to engage one of the left and right lug members 22, 24 so as to permit the tubular shaft 3 to be rotatably engaged with the head unit 2. In this embodiment, the first spring-loaded member 5 includes a spring 51 disposed in the recess 34 and a round head pin 52. As shown in FIG. 6, the round head pin 52 has a spherical head surface 521 and an end hole 522 opposite to the spherical head surface 521. A top end of the spring 51 is received in the end hole 522 to bias the spherical head surface 521 of the round head pin 52 to extend outwardly of the outer surface 31 of the tubular shaft 3 and to engage said one of the left and right lug members 22, 24. The round head pin 52 is made of rigid metal, such as a steel material.

Figure 5:
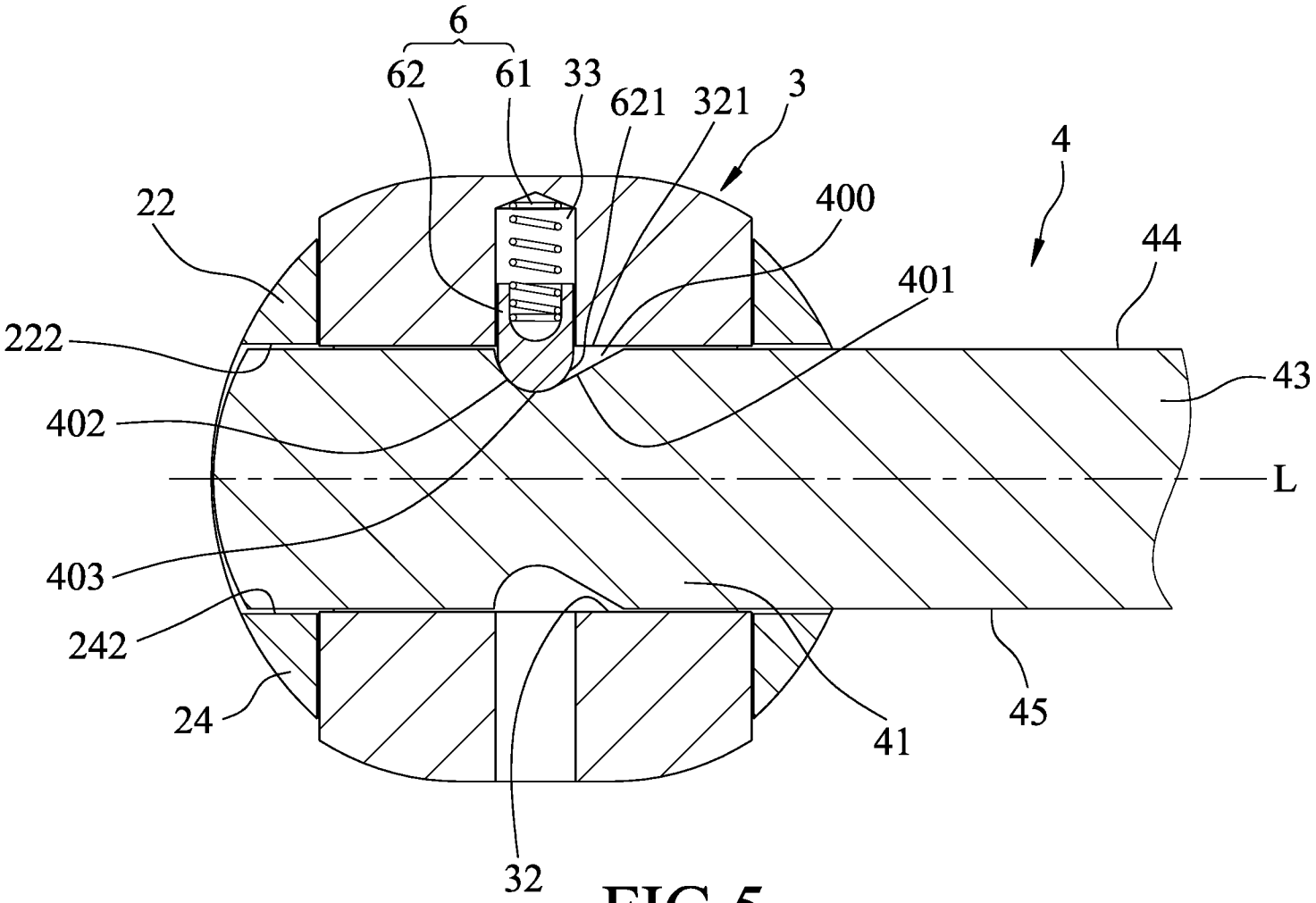
FIG. 5 is a fragmentary cross-sectional view taken along line V-V of FIG. 4.

The second spring-loaded member 6 has a second biasing force. The second spring-loaded member 6 is disposed in an inner peripheral surface 32 of the tubular shaft 3 which defines the through bore 321, and extends into the through bore 321 such that when the handle rod 4 is disposed to extend through the through bore 321, the second spring-loaded member 6 is urged by the second biasing force to engage the handle rod 4 so as to permit the handle rod 4 to be slidably engaged with the tubular shaft 3. The second spring-loaded member 6 is displaceable between a partially engaged position (not shown), where the handle rod 4 is in the middle position, and a fully engaged position (see FIGS. 5 and 6), where the handle rod 4 is in one of the forward and rearward positions. As shown in FIGS. 3, 5, and 6, a recess 33 is formed in the inner peripheral surface 32 of the tubular shaft 3, and the second spring-loaded member 6 includes a spring 61 disposed in the recess 33 and a round head pin 62. The round head in 62 has a spherical head surface 621 and an end hole 622 opposite to the spherical head surface 621. One end of the spring 61 is received in the end hole 622 to bias the spherical head surface 621 of the round head pin 62 to extend into the through bore 321 of the tubular shaft 3 so as to permit the round head pin 62 to be engaged in the cavity 400 when the second spring-loaded member 6 is in the fully engaged position. The round head pin 62 is made of rigid metal, such as a steel material.

As best shown in FIG. 5, each of the front and rear end segments 41, 42 of the handle rod 4 has a cavity 400 configured to permit the round head pin 62 of the second spring-loaded member 6 to be engaged therein when the second spring-loaded member 6 is in the full y engaged position. The cavity 400 extends inwardly of the handle rod 4 to form an inner ramp-up surface 401 and an inner barrier surface 402. The inner ramp-up surface 401 and the inner harrier surface 402 are opposite to each other in a direction of the lengthwise axis (L), and are disposed proximate to and distal from the middle segment 43, respectively. The inner ramp-up surface 401 is configured to permit the second spring-loaded member 6 to slide out of the cavity 400 against the second biasing force to thereby permit the handle rod 4 to move away from a corresponding one of the forward and rearward positions.

In this embodiment the cavity 400 has a lowest region 403 having a depth, which is larger than a radius of curvature of the spherical head surface 621 and is smaller than twice the radius of curvature. The cavity 400 has a width in the direction of the lengthwise axis (L), and the width is smaller than a length of the through bore 321 in the direction of the lengthwise axis (L). In addition, the cavity 400 extends in a circumferential direction to surround the lengthwise axis (L). The inner barrier surface 402 is configured to be matingly engaged with an outer surface (i.e., the spherical head surface 621) of the second spring-loaded member 6 when the second spring-loaded member 6 is in the fully engaged position.

Moreover, the inner ramp-up surface 401 and the inner barrier surface 402 extend divergently from the lowest region 403 by first and second lengths, respectively. A ratio of the second length to the first length ranges from 1:2 to 1:3.5. When the ratio of the second length to the first length is larger than 1/2, the inner ramp-up surface 401 is too steep, and it might be difficult for the second spring-loaded member 6 to slide out of the cavity 400 against the second biasing force. When the ratio of the second length to the first length is less than 0.286 (i.e., 1/3.5), the cavity 400 has a larger width in the direction of the lengthwise axis (L), and a contact surface between the tubular shaft 3 and the handle rod 4 is reduced. In this case, the handle rod 4 might crack due to stress concentration on the lowest region 403 of the cavity 400 after a period of use of the socket wrench. In an example of the socket wrench, the ratio of the second length to the first length is 1:2.75.

With reference to FIGS. 4 and 5, the handle rod 4 has two outer surface regions 44, 45 which are diametrically opposite to each other, and which are configured to fittingly mate with the inner surfaces 222, 242 of the left and right lug members 22, 24, respectively. The gap 20 has a width substantially the same as a distance between the two outer surface regions 44, 45 of the handle rod 4 such that when a force is exerted on the handle rod 4 for rotating the driving member 23, the handle rod 4 can abut against the inner peripheral surface 32 of the tubular shaft 3 and the inner surfaces 222, 242 of the left and right lug members 22, 24, so as to permit the force to be distributed more evenly.

Figure 7:
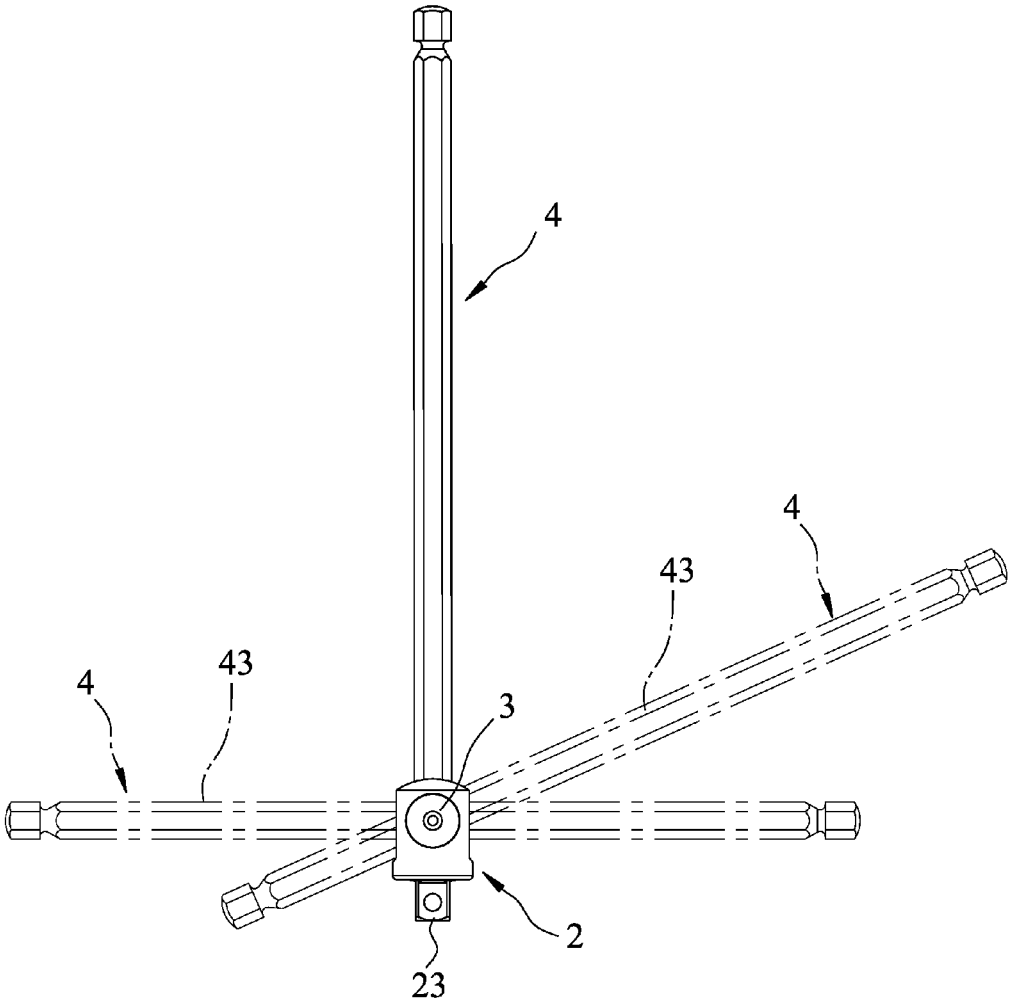
FIG. 7 is a schematic side view of the socket wrench according to the first embodiment of the disclosure.
Figure 8:
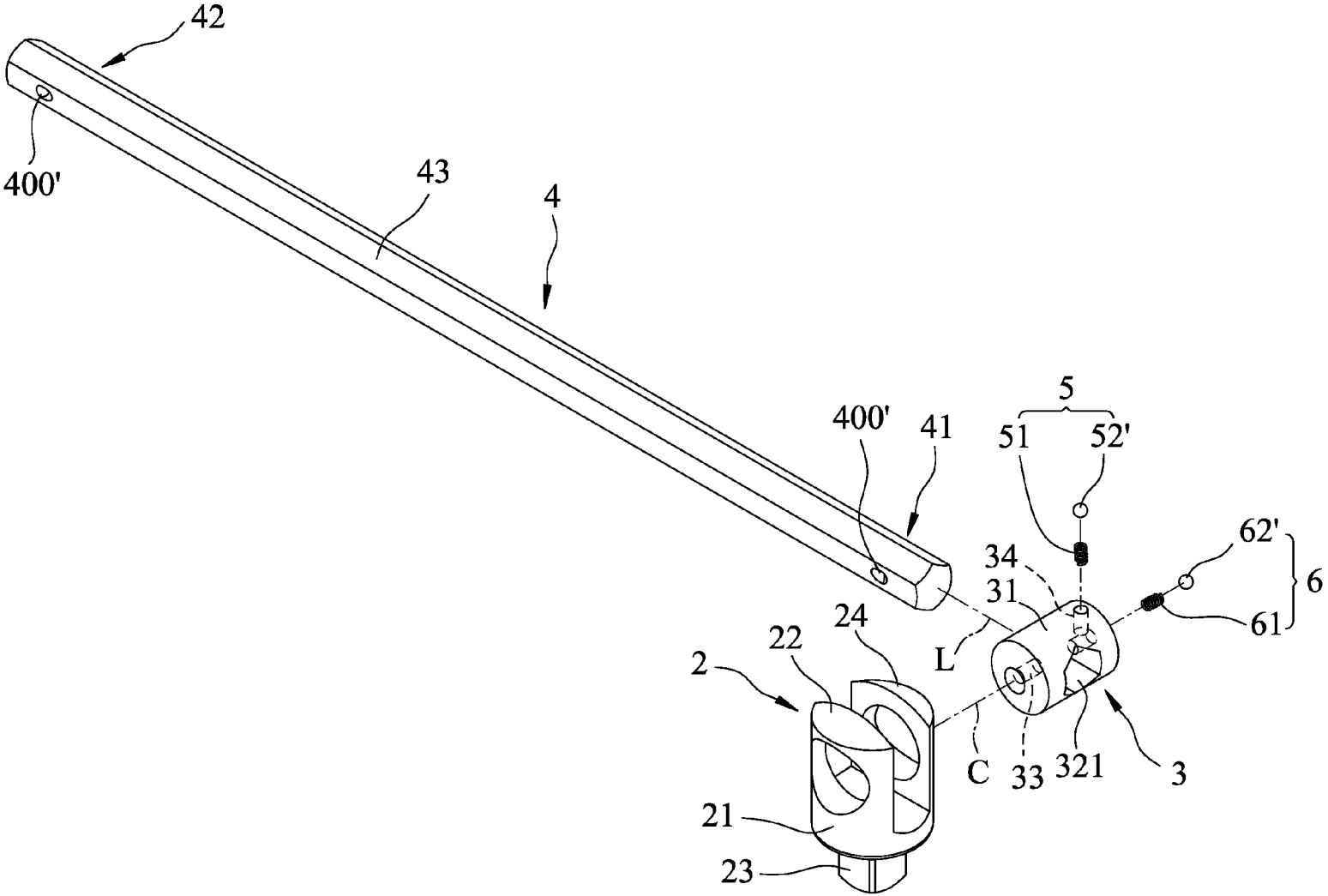
FIG. 8 is an exploded perspective view of a socket wrench according to a second embodiment of the disclosure.
Figure 9:
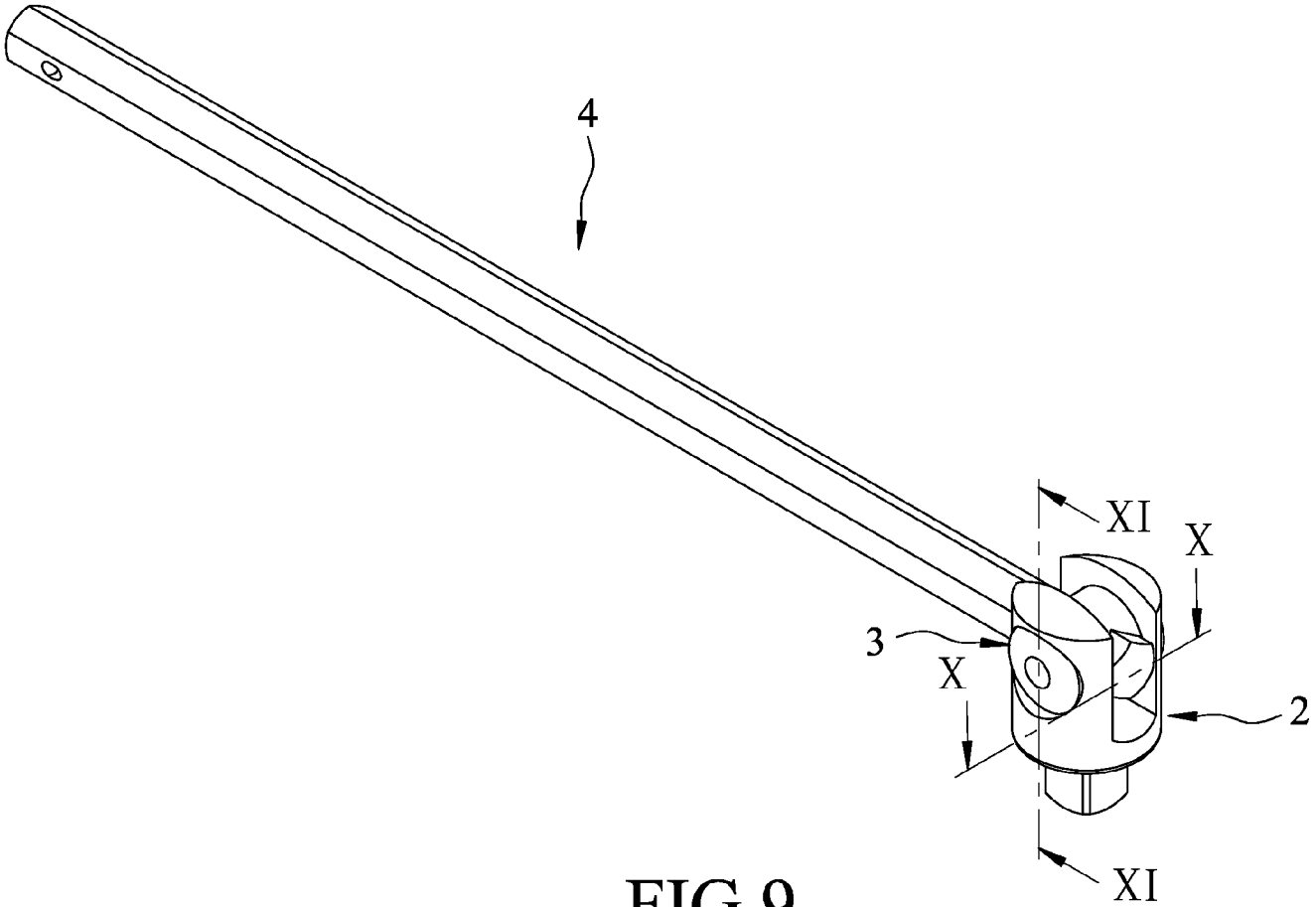
FIG. 9 is a perspective view of the socket wrench of the second embodiment in an assembled state.
Figure 10:
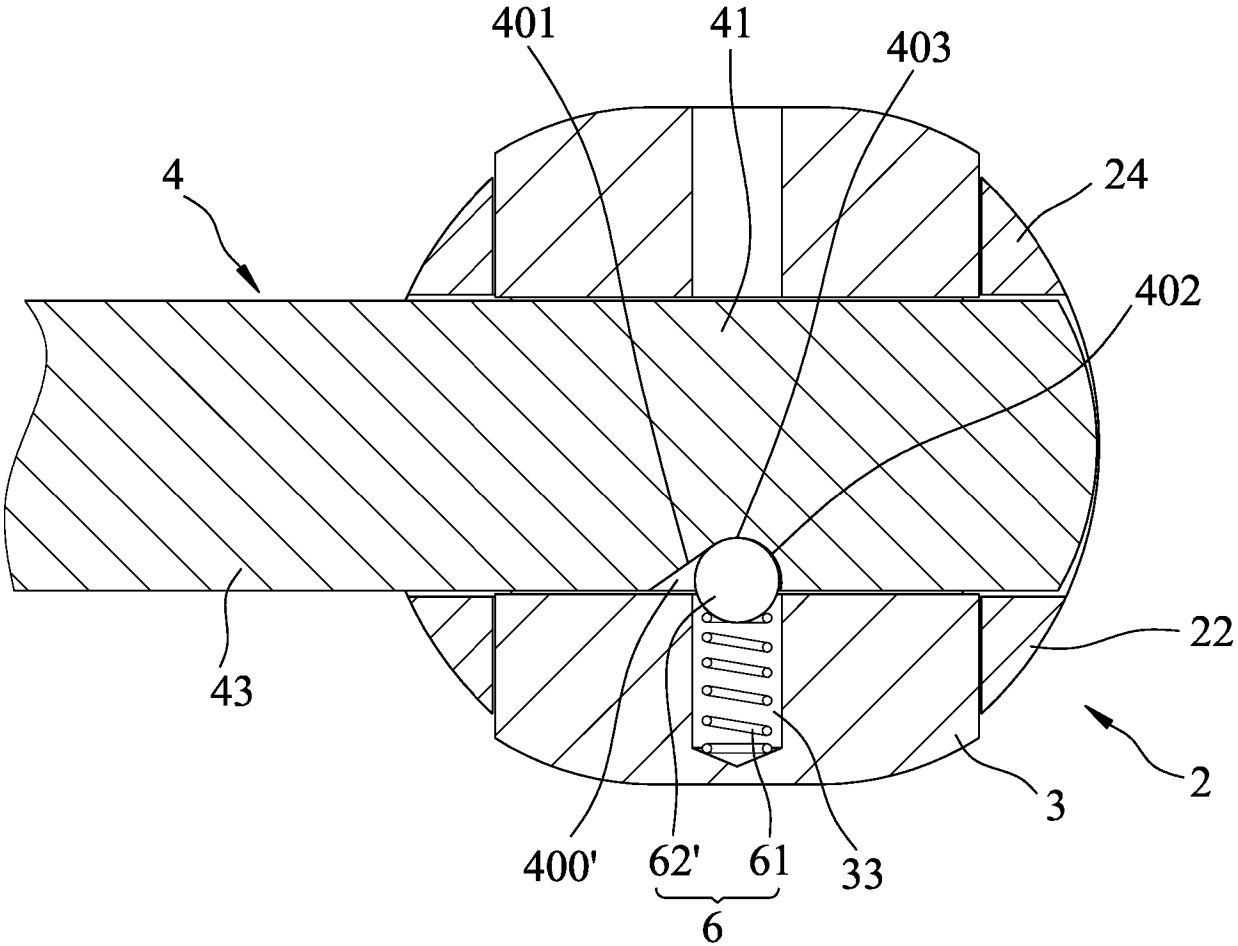
FIG. 10 is a fragmentary cross-sectional view taken along line X-X of FIG. 9.
Figure 11:
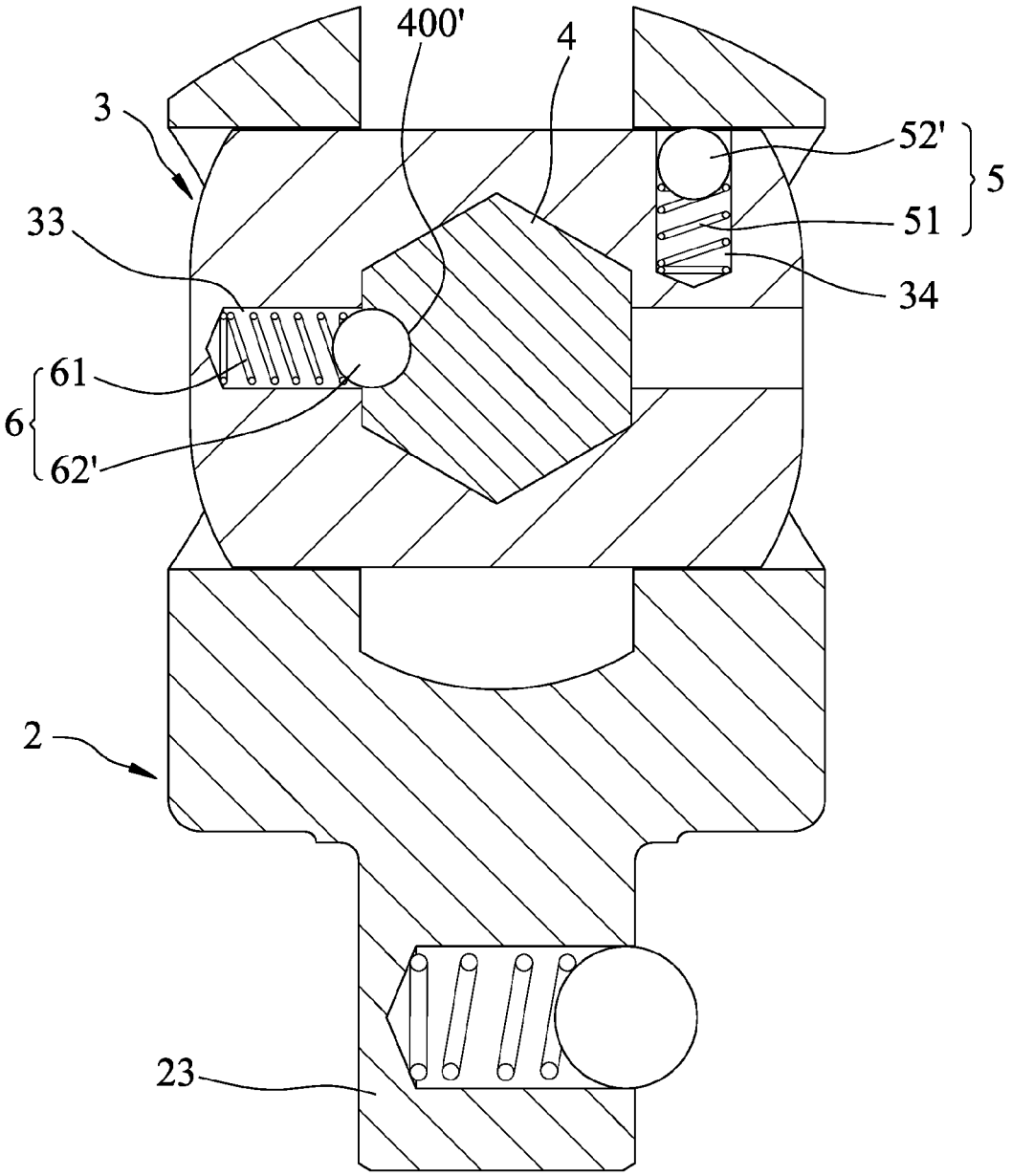
FIG. 11 is a cross-sectional view taken along line XI-XI of FIG. 9.

As shown in FIGS. 4 and 7, each end of the handle rod 4 can be fully received between the left and right lug members 22, 24 so as to permit the socket wrench to be used in a limited space. In addition, the handle rod 4 can rotate about the central axis (C) (see FIGS. 3 and 7) to permit each end of the handle rod 4 to be disposed between the base 21 and the tubular shaft 2. Because the handle rod 4 cannot rotate about the lengthwise axis (L), the force exerted on the handle rod 4 can more effectively rotate the driving member 23.

FIGS. 8 to 11 illustrate a socket wrench according to a second embodiment of the disclosure. The second embodiment is similar to the first embodiment except that, in the second embodiment, each of the front and rear segments 41, 42 of the handle rod 4 has a cavity 400' which is not an annular cavity.

Please note that in the first embodiment, when the handle rod 4 is in the forward or rearward position, there is a gap (G) between the handle rod 4 and the tubular shaft 3 (see FIG. 6) due to the provision of cavity 400 (an annular cavity). In the first embodiment, the provision of the annular cavity 400 facilitates the installation of the second spring-loaded member 6. In the second embodiment, when the handle rod 4 is in the forward or rearward position, a contact surface between the handle rod 4 and the tubular shaft 3 is increased (see FIG. 11) in comparison with the first embodiment. Thus, when the socket wrench of the second embodiment is used with the handle rod 4 in the forward or rearward position, the handle rod 4 is less likely to break.

Furthermore, the first spring-loaded member 5 includes a spring 51 disposed in the recess 34 and a ball 52' made of steel. The ball 52' is biased by the spring 51 to extend outwardly of the outer surface 31 of the tubular shaft 3. The second spring-loaded member 6 includes a spring 61 disposed in the inner peripheral surface 32 of the tubular shaft 3, and a bail 62' urged by the spring 61 to extend into the through bore 321. The inner barrier surface 402 is configured to be matinly engaged with an outer surface of the ball 62' when the second spring-loaded member 6 is in the fully engaged position.

Moreover, the cavity 400' has a depth larger than a radius of the ball 62' and smaller than a diameter of the ball 62'.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A socket wrench comprising:

a head unit including a base, a driving member extending downwardly from said base, and left and right lug members which extend upwardly from said base and which are spaced apart from each other by a gap in a transverse direction, each of said left and right lug members having a slot extending along a central axis in the transverse direction;

a tubular shaft extending along the central axis to terminate at left and right journal ends which are respectively journaled in said slots of said left and right lug members so as to permit said tubular shaft to be rotatable about the central axis, said tubular shaft having a through bore which extends in a radial direction relative to the central axis, and which has a polygonal contour;

a handle rod defining a lengthwise axis, and having front and rear end segments opposite to each other, and a middle segment disposed between said front and rear end segments, said handle rod being configured to extend through said through bore such that said handle rod is displaceable among a forward position, where said front end segment is in said through bore, a rearward position, where said rear end segment is in said through bore, and a middle position, where said middle segment is in said through bore, said handle rod having a polygonal cross-section to mate with the polygonal contour of said through bore so as to prevent rotation of said handle rod about the lengthwise axis;

a first spring-loaded member having a first biasing force, said first spring-loaded member being disposed in said tubular shaft and extending outwardly of an outer surface of said tubular shaft such that when said left and right journal ends of said tubular shaft are respectively journaled in said slots of said left and right lug members, said first spring-loaded member is urged by the first biasing force to engage one of said left and right lug members so as to permit said tubular shaft to be rotatable engaged with said head unit; and a second spring-loaded member having a second biasing force, said second spring-loaded member being disposed in an inner peripheral surface of said tubular shaft which defines said through bore, and extending into said through bore such that when said handle rod extends through said through bore, said second spring-loaded member is urged by the second biasing force to engage said handle rod so as to permit said handle rod to be slidably engaged with said tubular shaft, said second spring-loaded member being displaceable between a partially engaged position, where said handle rod is in the middle position, and a fully engaged position, where said handle rod is in one of the forward and rearward positions, wherein each of said front and rear end segments of said handle rod has a cavity configured to permit said second spring-loaded member to be engaged therein when said second spring-loaded member is in the fully engaged position, said cavity extending inwardly to form an inner ramp-up surface and an inner barrier surface, said inner ramp-up surface and said inner barrier surface being opposite to each other in a direction of the lengthwise axis, and disposed proximate to and distal from said middle segment, respectively, said inner ramp-up surface being configured to permit said second spring-loaded member to slide out of said cavity against the second biasing force to thereby permit said handle rod to move away from a corresponding one of the forward and rearward positions.

2. The socket wrench according to claim 1, wherein said cavity extends in a circumferential direction to surround the lengthwise axis.

3. The socket wrench according to claim 1, wherein said left and right lug members respectively have inner surfaces, which are spaced apart from each other by said gap, and wherein said handle rod has two outer surface regions which are diametrically opposite to each other, and which are configured, to fittingly mate with said inner surfaces of said left and right lug members, respectively.

4. The socket wrench according to claim 1, wherein said cavity has a lowest region, said inner ramp-up surface and said inner barrier surface extending divergently from said lowest region by first and second lengths, respectively, a ratio of the second length to the first length ranging from 1:2 to 1:3.5.

5. The socket wrench according to claim 1, wherein said inner barrier surface is configured to be matingly engaged with an outer surface of said second spring-loaded member when said second spring-loaded member is in the fully engaged position.

6. The socket wrench according to claim 2, wherein said tubular shaft has a recess formed in said inner peripheral surface, said second spring-loaded member including a spring which is disposed in said recess, and a round head pin which has a spherical head surface and which is biased by said spring to permit said round head pin to be engaged in said cavity when said second spring-loaded member is in the fully engaged position.

7. The socket wrench according to claim 6, wherein said cavity has a depth which is larger than a radius of curvature of said spherical head surface.

8. The socket wrench according to claim 1, wherein said tubular shaft has a recess formed in said outer surface said tubular shaft, said first spring-loaded member including a spring which is disposed in said recess, and a round head pin which is biased by said spring to extend outwardly of said outer surface of said tubular shaft and to engage said one of said left and right lug members.

* * * * *